US010140804B2

(12) United States Patent
Traphagen

(10) Patent No.: US 10,140,804 B2
(45) Date of Patent: Nov. 27, 2018

(54) COORDINATED GAMING MACHINE ATTRACT VIA GAMING MACHINE CAMERAS

(71) Applicant: IGT, Las Vegas, NV (US)

(72) Inventor: Brandon H. Traphagen, Reno, NV (US)

(73) Assignee: IGT, Las Vegas, NV (US)

( * ) Notice: Subject to any disclaimer, the term of this patent is extended or adjusted under 35 U.S.C. 154(b) by 26 days.

(21) Appl. No.: 15/227,706

(22) Filed: Aug. 3, 2016

(65) Prior Publication Data

US 2016/0343197 A1 Nov. 24, 2016

Related U.S. Application Data

(63) Continuation of application No. 14/032,790, filed on Sep. 20, 2013, now Pat. No. 9,412,222.

(51) Int. Cl.
*G07F 17/32* (2006.01)
*G06Q 50/34* (2012.01)
(Continued)

(52) U.S. Cl.
CPC ..... *G07F 17/3206* (2013.01); *G06Q 50/34* (2013.01); *G07F 17/32* (2013.01);
(Continued)

(58) Field of Classification Search
CPC ..... G07F 17/3202; G07F 17/3204; G07F 17/3206; G07F 17/3216; G07F 17/3223;
(Continued)

(56) References Cited

U.S. PATENT DOCUMENTS 3,533,629 A 10/1970 Raven
4,521,014 A * 6/1985 Sitrick ..... A63F 13/12 463/31
(Continued)

FOREIGN PATENT DOCUMENTS

AU 199943487 3/2000
WO WO 9858059 12/1998
(Continued)

*Primary Examiner* — Omkar Deodhar
*Assistant Examiner* — Matthew D Hoel
(74) *Attorney, Agent, or Firm* — Neal, Gerber & Eisenberg LLP

(57) ABSTRACT

Systems and methods for initiating attract sequences on gaming machines based on a determined presence of a player through a camera are described. The gaming machine includes a cabinet. The gaming machine further includes a display coupled to the cabinet. The gaming machine includes a user input coupled to the cabinet. The gaming machine includes a video camera coupled to the cabinet, the video camera configured to output video data, wherein the video camera is positioned to capture video data of players walking by the gaming machine. The gaming machine includes a master gaming controller. The master gaming controller is configured to receive the video data from the video camera, determine the presence of a player in the vicinity of the gaming machine, and initiate an attract feature based on the determined presence of the player.

17 Claims, 6 Drawing Sheets

(51) Int. Cl.
*G07F 17/34* (2006.01)
*G07F 17/42* (2006.01)

(52) U.S. Cl.
CPC ..... *G07F 17/3211* (2013.01); *G07F 17/3225* (2013.01); *G07F 17/3241* (2013.01); *G07F 17/3251* (2013.01); *G07F 17/3293* (2013.01); *G07F 17/34* (2013.01); *G07F 17/42* (2013.01)

(58) Field of Classification Search
CPC ..... G07F 17/3225; G07F 17/3227; G07F 17/323; G07F 17/3237; G07F 17/3249; G07F 17/3241; G07F 17/3255; G07F 17/3218; G07F 17/3211; G07F 17/3251; G07F 17/3293; G07F 17/34; G07F 17/42; G06Q 50/34
See application file for complete search history.

(56) References Cited

U.S. PATENT DOCUMENTS 4,522,399 A 6/1985 Nishikawa
4,572,509 A * 2/1986 Sitrick ..... A63F 13/12 463/31
5,133,017 A 7/1992 Cain et al.
5,259,613 A 11/1993 Marnell, II
5,318,298 A 6/1994 Kelly et al.
5,370,399 A 12/1994 Liverance
5,444,786 A 8/1995 Raviv
5,469,510 A 11/1995 Blind et al.
5,524,888 A 6/1996 Heidel
5,530,458 A 6/1996 Wakasu
5,533,727 A 7/1996 DeMar
5,542,669 A 8/1996 Charron et al.
5,553,864 A * 9/1996 Sitrick ..... B05B 15/001 348/E5.058
5,655,961 A 8/1997 Acres et al.
5,695,188 A 12/1997 Ishibashi
5,743,798 A 4/1998 Adams et al.
5,762,552 A 6/1998 Vuong et al.
5,775,993 A 7/1998 Fentz et al.
5,807,177 A 9/1998 Takemoto et al.
5,816,918 A 10/1998 Kelly et al.
5,828,768 A 10/1998 Eatwell et al.
5,830,065 A * 11/1998 Sitrick ..... A63F 13/00 348/E5.058
5,833,538 A 11/1998 Weiss
5,851,148 A 12/1998 Brune et al.
5,941,773 A 8/1999 Harlick
5,971,850 A 10/1999 Liverance
6,056,640 A 5/2000 Schaaij
6,068,552 A 5/2000 Walker et al.
6,089,663 A 7/2000 Hill
6,110,041 A 8/2000 Walker et al.
6,162,121 A 12/2000 Morrow et al.
6,217,448 B1 4/2001 Olsen
6,254,483 B1 7/2001 Acres
6,302,790 B1 10/2001 Brossard
6,308,953 B1 10/2001 Nagano
6,315,666 B1 11/2001 Mastera et al.
6,319,125 B1 11/2001 Acres
6,350,199 B1 2/2002 Williams et al.
6,416,411 B1 7/2002 Tsukahara
6,422,941 B1 7/2002 Thorner et al.
6,425,825 B1 * 7/2002 Sitrick ..... A63F 13/00 348/E5.058
6,471,589 B1 10/2002 Nagano
6,530,842 B1 3/2003 Wells et al.
6,561,908 B1 5/2003 Hoke
6,575,829 B2 6/2003 Coleman et al.
6,638,169 B2 10/2003 Wilder et al.
6,676,514 B1 1/2004 Kusuda et al.
6,805,633 B2 10/2004 Hein, Jr. et al.
6,843,723 B2 1/2005 Joshi
6,843,725 B2 1/2005 Nelson
6,848,219 B2 2/2005 Standard et al.
6,848,996 B2 2/2005 Hecht et al.
6,968,063 B2 11/2005 Boyd
7,048,630 B2 5/2006 Berg et al.
7,137,892 B2 * 11/2006 Sitrick ..... A63F 13/00 463/31
7,364,508 B2 4/2008 Loose et al.
7,456,755 B2 11/2008 Blum et al.
7,867,086 B2 * 1/2011 Sitrick ..... B05B 15/001 463/30
8,057,303 B2 11/2011 Rasmussen et al.
8,062,115 B2 11/2011 Thomas et al.
8,187,073 B2 5/2012 Beaulieu et al.
8,235,804 B2 8/2012 Gagner et al.
8,241,119 B2 8/2012 Wells
8,342,950 B1 1/2013 Dorr
8,357,036 B1 1/2013 Dorr
8,401,981 B1 * 3/2013 Sandler ..... G06F 1/1626 706/12
8,500,562 B2 8/2013 Walker et al.
8,545,321 B2 10/2013 Baerlocher et al.
8,556,714 B2 10/2013 Bowers et al.
8,613,667 B2 12/2013 Brunell et al.
8,651,939 B2 2/2014 Nordman
8,694,445 B1 * 4/2014 Sandler ..... G06F 1/1626 706/12
8,876,598 B2 11/2014 Loose et al.
8,979,626 B2 3/2015 Walker et al.
9,390,582 B2 7/2016 McIntyre et al.
2001/0004607 A1 6/2001 Olsen
2002/0037763 A1 3/2002 Idaka
2002/0039919 A1 4/2002 Joshi et al.
2002/0090990 A1 7/2002 Joshi et al.
2002/0132663 A1 * 9/2002 Cumbers ..... G06K 9/00288 463/25
2002/0142825 A1 10/2002 Lark et al.
2002/0142846 A1 10/2002 Paulsen
2002/0151349 A1 10/2002 Joshi
2003/0017872 A1 * 1/2003 Oishi ..... A63F 13/10 463/33
2003/0054881 A1 3/2003 Hedrick et al.
2003/0064771 A1 * 4/2003 Morrow ..... G07F 17/323 463/16
2003/0066073 A1 4/2003 Rebh
2003/0073490 A1 4/2003 Hecht et al.
2003/0073491 A1 4/2003 Hecht et al.
2003/0100359 A1 5/2003 Loose et al.
2003/0114214 A1 6/2003 Barahona et al.
2003/0211881 A1 11/2003 Walker et al.
2003/0220139 A1 11/2003 Peterson
2004/0029637 A1 2/2004 Hein, Jr. et al.
2004/0053695 A1 * 3/2004 Mattice ..... G07F 17/32 463/42
2004/0082388 A1 4/2004 Simsek et al.
2004/0138889 A1 7/2004 Gilboy et al.
2004/0147316 A1 7/2004 Nagano
2005/0068311 A1 3/2005 Fletcher et al.
2006/0139326 A1 6/2006 Tsukamoto
2006/0160624 A1 7/2006 Slomiany et al.
2006/0281543 A1 12/2006 Sutton et al.
2007/0077784 A1 4/2007 Kalayjian et al.
2008/0111698 A1 5/2008 Atherton
2009/0160541 A1 6/2009 Liu et al.
2009/0163267 A1 6/2009 Fine
2009/0191946 A1 7/2009 Thomas et al.
2010/0151943 A1 6/2010 Johnson et al.
2010/0285868 A1 11/2010 Anderson et al.
2011/0008196 A1 1/2011 Liu
2011/0039605 A1 2/2011 Choi et al.
2011/0040989 A1 2/2011 Keyes
2011/0234152 A1 9/2011 Frossen et al.
2011/0260689 A1 10/2011 Kano
2011/0275428 A1 11/2011 Forman et al.
2012/0108293 A1 5/2012 Law et al.
2012/0231886 A1 9/2012 Gomez et al.
2012/0324384 A1 12/2012 Cohen et al.
2013/0053148 A1 * 2/2013 Nelson ..... G07F 17/323 463/42

(56) References Cited

U.S. PATENT DOCUMENTS

| | | | | |
|---|---|---|---|---|
| 2013/0099927 | A1* | 4/2013 | Kulinets | G01S 5/0009 340/572.1 |
| 2013/0232003 | A1* | 9/2013 | Yeo | G06Q 30/0251 705/14.49 |
| 2014/0162768 | A1 | 6/2014 | Nelson et al. | |
| 2014/0346160 | A1* | 11/2014 | Moench | B60H 1/00742 219/202 |
| 2017/0069165 | A1 | 3/2017 | Shorrock et al. | |

FOREIGN PATENT DOCUMENTS

| | | | |
|---|---|---|---|
| WO | WO 0105477 | A2 | 1/2001 |
| WO | WO 0105477 | A3 | 1/2001 |
| WO | WO 0133905 | A2 | 5/2001 |
| WO | WO 0139905 | A3 | 5/2001 |
| WO | WO 0224288 | A2 | 3/2002 |
| WO | WO 0224288 | A3 | 3/2002 |
| WO | WO 0240921 | A3 | 5/2002 |

* cited by examiner

COORDINATED GAMING MACHINE ATTRACT VIA GAMING MACHINE CAMERAS

PRIORITY CLAIM

This application is a continuation of, claims priority to and the benefit of U.S. patent application Ser. No. 14/032,790, filed on Sep. 20, 2013, the entire contents of which is incorporated by reference herein.

BACKGROUND

The present disclosure relates generally to gaming machines and gaming systems, and more particularly to a gaming machine having a video camera.

Many of today's gaming casinos and other entertainment locations feature different single and multi-player gaming systems, such as slot machines and video poker machines, that enable players to play wager-based games. Wager-based games generally refer to games in which a player risks a certain amount of money or credits on a round of game play. If the outcome of the round is favorable to the player, he or she may be awarded an amount of money or credits equal to or greater than the amount risked by the player. However, if the outcome of the round of game play is unfavorable to the player, the player loses the risked amount and receives nothing.

Gaming machines are highly regulated to ensure fairness. In many cases, gaming machines may be operable to dispense monetary awards of a large amount of money. Accordingly, access to gaming machines is often carefully controlled. For example, in some jurisdictions, routine maintenance requires that extra personnel (e.g., gaming control personnel) be notified in advance and be in attendance during such maintenance. Additionally, gaming machines may have hardware and software architectures that differ significantly from those of general-purpose computers (PCs), even though both gaming machines and PCs employ microprocessors to control a variety of devices. For example, gaming machines may have more stringent security requirements and fault tolerance requirements. Additionally, gaming machines generally operate in harsher environments as compared with PCs.

In many casinos and other entertainment locations, the gaming machines are configured to present an attract sequence to attract players to the games. The attract sequence may include flashing lights, sounds, image presentations, video presentations, or any combination thereof. The attract sequences performed on the gaming machines may be energy intensive. Further, the attract sequences performed on the gaming machines may distract and annoy players of other gaming machines and casino patrons in the vicinity of the gaming machines performing the attract sequences.

SUMMARY

An exemplary embodiment relates to a gaming machine configured to perform an attract feature based on a determined presence of a player. The gaming machine includes a cabinet. The gaming machine further includes a display coupled to the cabinet. The gaming machine includes a user input coupled to the cabinet. The gaming machine includes a video camera coupled to the cabinet, the video camera configured to output video data, wherein the video camera is positioned to capture video data of players walking by the gaming machine. The gaming machine includes a master gaming controller. The master gaming controller is configured to receive the video data from the video camera, determine the presence of a player in the vicinity of the gaming machine, and initiate an attract feature based on the determined presence of the player.

Another exemplary embodiment relates to a gaming system configured to perform an attract feature on a gaming machine based on a determined presence of a player in the vicinity of the gaming machine. The gaming system includes a plurality of electronic gaming machines. Each of the plurality of gaming machines includes a cabinet, a display coupled to the cabinet, a user input coupled to the cabinet, a video camera coupled to the cabinet, the video camera configured to output video data, wherein the video camera is positioned to capture video data of players walking by the gaming machine, and a master gaming controller. The gaming system further includes a server configured to receive video data from each of the plurality of electronic gaming machines, the server including a processing circuit configured to analyze the video data, determine the presence of a player in the vicinity of the plurality of gaming machines, and initiate an attract feature on at least one of the plurality of gaming machines based on the determined presence of the player.

Yet another exemplary embodiment relates to a method in a gaming system of performing an attract feature on a gaming machine based on a detected presence of a player. The method includes receiving, at a processing circuit of the gaming system, data from a camera of the gaming machine. The method further includes analyzing, by the processing circuit, the data. The method includes determining, by the processing circuit, the presence of the player in the vicinity of the gaming machine. The method further includes instructing, by the processing circuit, an attract sequence to be performed by the gaming system.

These embodiments are mentioned not to limit or define the scope of the disclosure, but to provide example implementations of the disclosure to aid in the understanding thereof. Particular embodiments may be developed to realize one or more of the following advantages.

BRIEF DESCRIPTION OF THE DRAWINGS

The details of one or more implementations are set forth in the accompanying drawings and the description below. Other features, aspects, and advantages of the disclosure will become apparent from the descriptions, the drawings, and the claims, in which:

Like reference numbers and designations in the various drawings indicate like elements.

DETAILED DESCRIPTION

Numerous specific details may be set forth below to provide a thorough understanding of concepts underlying the described embodiments. It may be apparent, however, to one skilled in the art that the described embodiments may be practiced without some or all of these specific details. In other instances, some process steps have not been described in detail in order to avoid unnecessarily obscuring the underlying concept.

According to various embodiments disclosed herein, electronic gaming machines, such as those used in casinos and other entertainment locations, may include video cameras. The cameras may be used in providing interactive features of games. For example, the cameras may be used to provide input to a wager-based game based on player movement or to capture images and/or videos of players for security or for game customization purposes. The cameras may also be used to determine when a patron is near or passing by a gaming machine. An attract feature of the gaming machine may be initiated based on the detected presence of the patron. The attract feature is configured to make noises, to flash lights, and to present images and videos in order to attract the passing-by patron to play the game.

In a typical casino gaming floor arrangement, multiple gaming machines are arranged in banks or rows. In such an arrangement, a patron's presence, direction of travel, line of sight, and field of vision may be determined through analyzing image and/or video data from the cameras of the gaming machines. Accordingly, the gaming system may be able to predict which gaming machines will be in the patron's line of sight and initiate attract sequences on the gaming machines that the player is most likely to see. Accordingly, the gaming machines that are most likely to be in the patron's line of sight may be used for attract sequences, and gaming machines not likely to be in the patron's line of sight may not be used in the attract sequences (i.e., remain in an idle state). The attract sequences may be coordinated across a plurality of gaming machines or may be independently performed by individual gaming machines.

Figure 1:
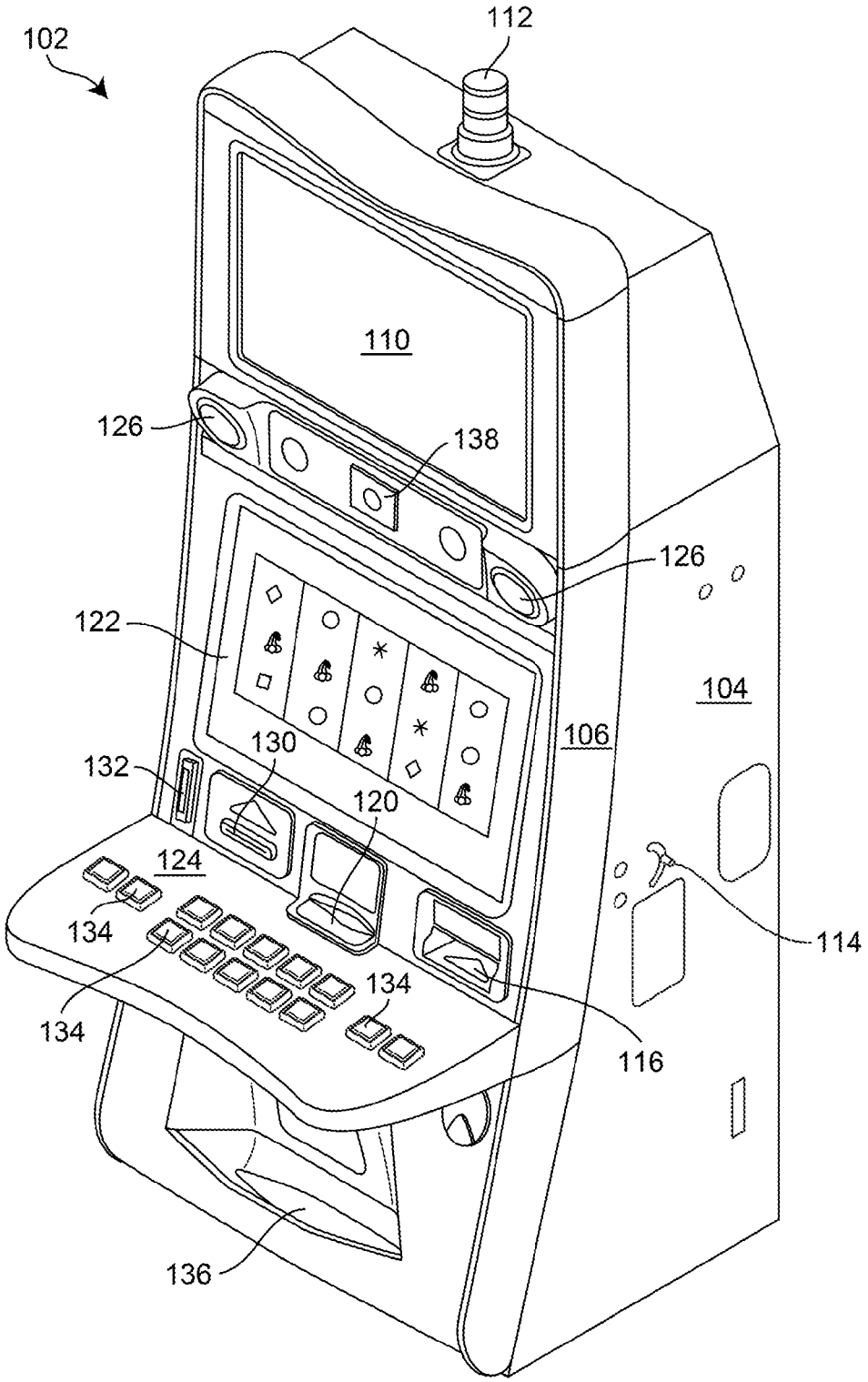
FIG. 1 is an illustration of a gaming machine, according to an exemplary embodiment.

Referring to FIG. 1, a perspective drawing of an electronic gaming machine 102 is shown in accordance with described embodiments. Gaming machine 102 may include a main cabinet 104. Main cabinet 104 may provide a secure enclosure that prevents tampering with device components, such as a game controller (not shown) located within the interior of main cabinet 104. Main cabinet 104 may include an access mechanism, such as a door 106, which allows the interior of gaming machine 102 to be accessed. Actuation of a door 106 may be controlled by a locking mechanism 114. In some embodiments, locking mechanism 114, door 106, and the interior of main cabinet 104 may be monitored with security sensors of various types to detect whether the interior has been accessed. For instance, a light sensor may be provided within main cabinet 104 to detect a change in light-levels when door 106 is opened and/or an accelerometer may be attached to door 106 to detect when door 106 is opened.

Gaming machine 102 may include any number of user interface devices that convey sensory information to a user and/or receive input from the user. For example, gaming machine 102 may include electronic displays 110, 122, speakers 126, and/or a candle device 112 to convey information to the user of gaming machine 102. Gaming machine 102 may also include a console 124 having one or more inputs 134 (e.g., buttons, track pads, etc.) configured to receive input from a user. In one embodiment, display 110 and/or display 122 may also be a touch screen display configured to receive input from a user. A controller (not shown) within gaming machine 102 may run a game, such as a wager-based game, in response to receiving input from a user via inputs 134, display 122, or display 110. For example, inputs 134 may be operated to place a wager in the game and to run the game. In response, the controller may cause reels shown on display 122 to spin, such as with a software-based slot game.

Gaming machine 102 may also include devices for conducting a wager-based game. For example, gaming machine 102 may include a ticket acceptor 116 and a printer 120. In various embodiments, gaming machine 102 may be configured to run on credits that may be redeemed for money and/or other forms of prizes. Ticket acceptor 116 may read an inserted ticket having one or more credits usable to play a game on gaming machine 102. For example, a player of gaming machine 102 may wager one or more credits within a video slot game. If the player loses, the wagered amount may be deducted from the player's remaining balance on gaming machine 102. However, if the player wins, the player's balance may be increased by the amount won. Any remaining credit balance on gaming machine 102 may be converted into a ticket via printer 120. For example, a player of gaming machine 102 may cash out of the machine by selecting to print a ticket via printer 120. The ticket may then be used to play other gaming machines or redeemed for cash and/or prizes. According to various embodiments, gaming machine 102 may record data regarding its receipt and/or disbursement of credits. For example, gaming machine 102 may generate accounting data whenever a result of a wager-based game is determined. In some embodiments, gaming machine 102 may provide accounting data to a remote data collection device, allowing the remote monitoring of gaming machine 102.

In one embodiment, gaming machine 102 may include a loyalty card acceptor 130. In general, a loyalty card may be tied to a user's loyalty account. A loyalty account may store various information about the user, such as the user's identity, the user's gaming preferences, the user's gaming habits (e.g., which games the user plays, how long the user plays, etc.), or similar information about the user. A loyalty account may also be used to reward a user for playing gaming machine 102. For example, a user having a loyalty account may be given a bonus turn on gaming machine 102 or credited loyalty points for playing gaming machine 102. Such loyalty points may be exchanged for loyalty rewards (e.g., a free meal, a free hotel stay, free room upgrade, discounts, etc.).

Gaming machine 102 may further include a camera 138. Camera 138 may be coupled to cabinet 104. Camera 138 may be positioned on the front side of gaming machine 102 such that camera 138 is positioned to take pictures and/or video of a player of gaming machine 102. Camera 138 may be positioned to take pictures and/or video of patrons walking by gaming machine 102. Camera 138 may also be configured to capture audio through a built-in or external microphone. Camera 138 may be positioned between speakers 126 (e.g., as shown in FIG. 1) or at any other suitable position on cabinet 104. Camera 138 may be a high-definition camera. In some arrangements, camera 138 may be a three-dimensional camera (e.g., a stereoscopic camera having at least two image sensors) or an infrared camera. Camera 138 may have an auto-focus feature such that camera 138 can capture clear images of a player in front of gaming machine as well as a patron walking by gaming machine at a further distance than a player would normally sit while playing gaming machine 102. Camera 138 may include night vision capabilities to enable photo and video capture in a dark environment.

Figure 2:
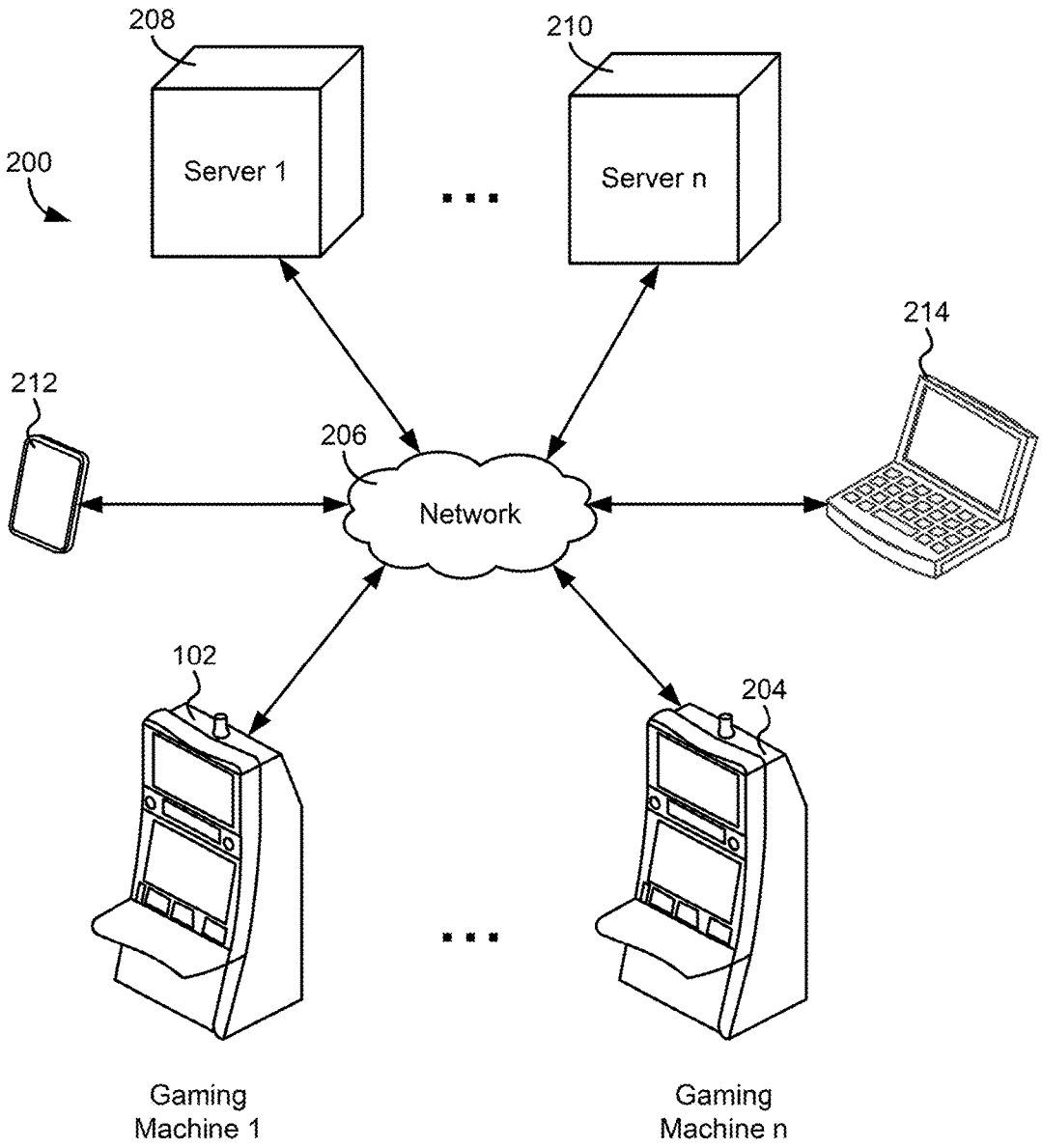
FIG. 2 is an illustration of a gaming system, according to an exemplary embodiment.

Referring now to FIG. 2, an illustration of a gaming system 200 is shown, according to an exemplary embodiment. In general, gaming system 200 is configured to allow any number of players to play instances of one or more wager-based games and to place side bets in the game instances. The players may all be located within the same entertainment location, located in different entertainment locations (e.g., different casinos), or may even be located outside of a gaming location altogether (e.g., remote players playing online games).

As shown, gaming system 200 may include any number of gaming machines, which may be located physically within one or more entertainment locations, such as casinos, racetracks, bars, etc. For example, gaming system 200 may include gaming machine 102 shown in FIG. 1 through a gaming machine 204 (i.e., a first gaming machine through nth gaming machine) on which wager-based games may be played. In further embodiments, gaming system 200 may include desktop computing devices, such as a desktop device 214, and/or mobile computing devices, such as a mobile device 212, which are configured to play wager-based games remotely. Gaming system 200 may also include any number of servers and other devices, such as server 208 through server 210 (e.g., a first server through nth server), which support the various functions described herein. Gaming environment may further include a network 206 through which gaming machines 102, 204, mobile device 212, desktop device 214, and/or servers 208, 210 communicate.

Network 206 may be any form of communications network that conveys data between gaming machines 102, 204 and servers 208, 210. In one embodiment, network 206 may also convey data between gaming machines 102, 204. For example, gaming machines 102, 204 may be gaming machines that execute a particular type of game that allows for social gaming (e.g., a player of gaming machine 102 may coordinate some of his or her in-game actions with the player of gaming machine 204, to achieve certain collaborative goals, bonuses, etc.). Network 206 may include any number of wired or wireless connections, in various embodiments. For example, server 208 may communicate with server 210 over a wired connection that includes a serial cable, a fiber optic cable, a CAT5 cable, or any other form of wired connection. In another example, server 208 may communicate with gaming machine 102 via a wireless connection (e.g., via WiFi, cellular, radio, etc.). Network 206 may also include any number of local area networks (LANs), wide area networks (WANs), or the Internet. For example, server 210 may communicate with gaming machine 102 via a casino's LAN and with mobile device 212 via the Internet. Accordingly, network 206 may include any number of intermediary networking devices, such as routers, switches, servers, etc.

In various embodiments, servers 208, 210 and gaming machines 102, 204 may utilize a gaming protocol, such as G2S or SAS, to communicate via network 206. Such a gaming protocol may include security features to ensure the integrity of communications between the devices in gaming system 200. For example, a communication between gaming machine 102 and server 208 using G2S may be encrypted using a secure socket layer (SSL) encryption technique. The communication may then be decrypted by the receiving device, thereby ensuring the integrity of the communicated data.

Mobile device 212 and desktop device 214 may each be computing devices having a processor and memory coupled thereto. Stored in the memories are machine instructions that, when executed by the processors, cause the processors to perform the operations described herein. In some embodiments, mobile device 212 and/or desktop device 214 are configured to execute gaming applications that allow their respective players to play wager-based games. For example, a gaming application executed by desktop device 214 may allow a player to play online poker and place wagers within the game. In a further embodiment, mobile device 212 may be configured to interface with gaming machines 102, 204. For example, mobile device 212 may communicate with gaming machine 204 during gameplay to control the gameplay, identify the player to gaming machine 204, or perform other such functions.

Servers 208, 210 may each be a single computing device or a collection of computing devices (e.g., a data center, cloud computing devices, etc.) that communicate via network 206. Each of servers 208, 210 may include one or more processors that execute machine instructions stored in electronic memories. In one embodiment, one or more of servers 208, 210 are configured to maintain an accounting of wager-based games played at gaming machines 102, 204, mobile device 212, and/or desktop device 214. In other words, one or more of servers 208, 210 may receive data regarding the cash in, cash out, and game outcomes of the games played at gaming machines 102, 204. For example, server 208 may receive data indicative of gaming machine 102 having received $5 in currency from a player. One or more of servers 208, 210 may also be configured to provide an accounting for remote players. For example, one or more of servers 208, 210 may store data indicative of the amount of funds added to the gaming account of the player using desktop device 214 (e.g., from a financial institution), transferred from the gaming account (e.g., deposited into the player's bank account), or changes to the amount of funds associated with the gaming account due to game outcomes.

One or more of servers 208, 210 may be configured to determine the outcome of a wager-based game played on gaming machines 102, 204, mobile device 212, or desktop device 214. For example, server 210 may provide the result of a round of gameplay to gaming machine 204. In some embodiments, server 210 may serve a thin client game to some or all of gaming machines 102, 204, mobile device 212, and desktop device 214. In contrast to thick client games, thin client games generally refer to gaming applications in which the game logic is executed on a remote device, such as server 210, and provided to another device running a thin client (e.g., gaming machine 204, mobile device 212, desktop device 214, etc.). For example, the game logic may be executed on server 210 and graphics representing the outcome of the game may be provided to gaming machine 204 for display within a thin client (e.g., Adobe Flash or another such application).

In some cases, servers 208, 210 may be configured to perform data analysis on data received from any of gaming machines 102, 204, mobile device 212, or desktop device 214. For example, one or more of servers 208, 210 may determine averages, trends, metrics, etc., for one or more of gaming machines 102, 204. Data may be sent between gaming machines 102, 204, mobile device 212, desktop device 214 and servers 208, 210 in real-time (e.g., whenever a change in credits or cash occurs, whenever another type of system event occurs, etc.), periodically (e.g., every fifteen minutes, every hour, etc.), or in response to receiving a message from one of the devices.

One or more of servers 208, 210 may be configured to maintain player loyalty accounts. In general, a loyalty account may include information about the player's identity, rewards or loyalty points earned by the player (e.g., for playing wager-based games, on the player's birthday, etc.), data linking the player's account to an account with a financial institution (e.g., to add game credits to the player's account, to cash out game credits, etc.), or other such information. For example, a user of gaming machine 102 may link his or her loyalty account to gaming machine 102, so that he or she can gain loyalty points, free turns, etc., while playing gaming machine 102. A user may link his or her loyalty account to a gaming machine in any number of ways. For example, the user may insert a loyalty card into gaming machine 102, provide biometric data to gaming machine 102 (e.g., by conducting a finger print scan, a retinal scan, etc.), and so on. In some cases, mobile device 212 operated by the user may provide data regarding the user's loyalty account to gaming machine 102. Mobile device 212 may transfer data to gaming machine 102 wirelessly (e.g., via Bluetooth, WiFi, etc.), via a wired connection (e.g., via a USB cable, a docking station, etc.), via the user's body (i.e., the mobile device transmits data through the user's body and into gaming machine 102), or in another manner. The receiving server may then associate the user's time playing gaming machine 102 with the user's loyalty account (e.g., to add loyalty points to the user's account, to provide certain rewards to the user, such as a bonus turn, etc.).

According to various implementations, one or more of servers 208, 210 are configured to receive image, video, and/or audio data from gaming machine cameras (e.g., from camera 138). For example, gaming machines 102, 204 are equipped with video cameras (e.g., camera 138). During game play, the video cameras may be used as a user input device or a game customization device. Additionally, during game play and/or when the gaming machine is not occupied by a player, the camera data may be provided to one or more servers 208, 210 for analysis to determine when a patron (e.g., a player not currently sitting at a gaming machine) is nearby. The camera data may be provided to the one or more servers 208, 210 in real time. The camera data may be analyzed by the one or more servers 208, 210 to determine when attract sequences should be performed on gaming machines. The one or more servers 208, 210 may instruct specific, unoccupied gaming machines to perform an attract sequence based on the patron's determined line of sight, direction of travel, and/or speed of travel. Occupied gaming machines may also perform attract sequences through outputs not being used in the provision of a game to the player occupying the gaming machine. For example, the attract sequence may be displayed on a top box display (e.g., display 110) and other lighting features (e.g., candle 112) to provide both game play and attract functions at the same time.

The attract sequences may be performed by a single gaming machine or multiple gaming machines. The attract sequence may be an individual attract sequence (i.e., independently performed by individual gaming machines) or a coordinated attract sequence amongst multiple gaming machines. For example, during a coordinated attract sequence, gaming machines may alternately light up and make noises as the player moves down a row of gaming machines. The details of the attract sequence triggers and presentations are discussed in further detail below.

Figure 3:
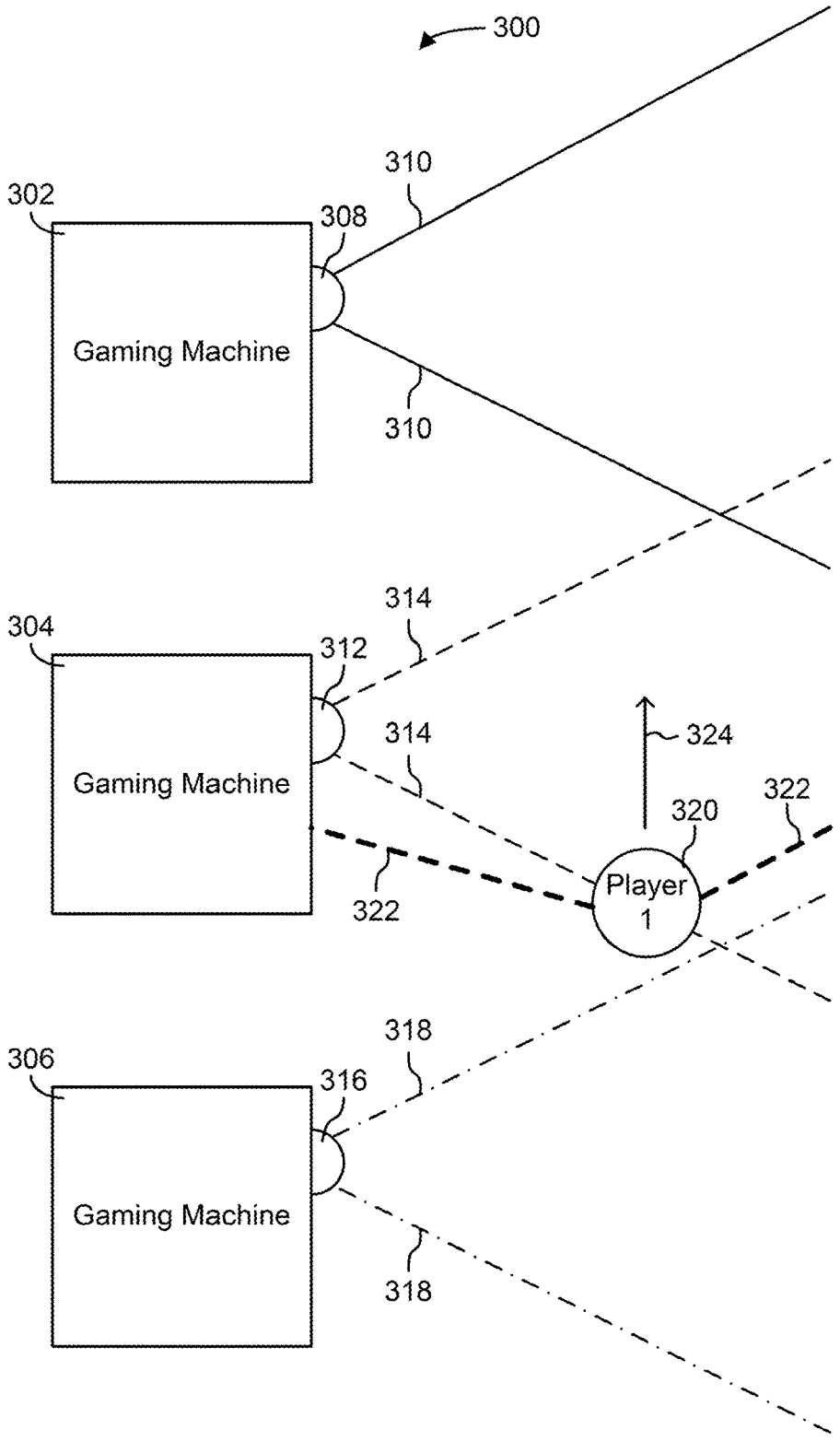
FIG. 3 is an illustration of a group of gaming machines, according to an exemplary embodiment.

Referring to FIG. 3, an illustration of a gaming system 300 having a group of gaming machines 302, 304, 306 is shown according to an exemplary embodiment. The group of gaming machines includes a first gaming machine 302, a second gaming machine 304, and a third gaming machine 306. Gaming machines 302, 304, 306 are arranged along a row. For example, gaming machines 302, 304, 306 may be part of a bank of gaming machines on a gaming floor of a casino. Each of gaming machines 302, 304, 306 includes a camera having a field of vision. Gaming machine 302 includes camera 308, which has a field of vision 310. Gaming machine 304 includes camera 312, which has a field of vision 314. Gaming machine 306 includes camera 316, which has a field of vision 318. Cameras 308, 312, 316 can detect objects (e.g., a player) within fields of vision 310, 314, 318.

Each gaming machine 302, 304, 306 may detect the presence of a player 320 when the player 320 is within a respective field of vision. The gaming machines 302, 304, 306 may individually detect the player's 320 presence by local processing of a controller of the gaming machine 302, 304, 306. Alternatively, each gaming machine 302, 304, 306 may provide image/video data from its respective camera 308, 312, 316 to a remote server (e.g., servers 208, 210) for remote detection and processing. The image/video data may be provided as a data stream. The data stream may be provided in real time.

In an exemplary arrangement of FIG. 3, each gaming machine 302, 304, and 306 is configured to individually detect the presence of people (e.g., player 320) within fields of vision 310, 314, 318 either locally (e.g., via a controller of the gaming machine processing the data from the camera) or remotely (e.g., on one of servers 208, 210). When an individual, such as player 320, is within a field of vision 310, 314, 318, the corresponding gaming machine 302, 304, 306 may be instructed to perform an attract sequence. The instruction may come from a controller of the gaming machine or remotely from a server. As shown in FIG. 3, the player 320 is currently within field of vision 314 of camera 312. Accordingly, the remote server and/or gaming machine 304 may detect the presence of player 320 in front of gaming machine 304 through analysis of the image/video data from camera 312. Upon detection of player 320, an attract sequence may be triggered on gaming machine 304. The attract sequence may include any of lights, noises, images, videos, or any combination thereof, presented via outputs of gaming machine 304. The attract sequence may only be performed if gaming machine 304 is unoccupied (i.e., nobody is playing a game on gaming machine 304).

In some arrangements, gaming machine 304 may present a limited version of an attract sequence even if gaming machine 304 is occupied. The limited version of the attract sequence does not utilize the main display of gaming machine 304 (e.g., display 122) as it is being used for the provision of a game to the occupying player. The limited version of the attract sequence may utilize other outputs such as a top box display (e.g., display 110), lighting features (e.g., candle 112), and audio emitters (e.g., speakers 126). Although player 320 may not play gaming machine 304 because it is occupied, player 320 may gain interest in the game being provided by gaming machine 304 and play the game on an adjacent gaming machine (e.g., gaming machines 302, 306).

Player 320 has a limited field of vision 322. Accordingly, the time period of effectiveness for the attract sequence on gaming machine 304 may be reduced by movement of player 320. For example, if player is moving in direction 324, by the time gaming machine 304 or the remote server detects the player's 320 presence in field of vision 314 of camera and initiates the attract sequence, gaming machine 304 may already be out of field of vision 322 of player 320. If gaming machine 304 is outside of field of vision 322, any visual features of the attract sequence may not be effective in gaining the attention of player 320, and the overall effectiveness of the attract sequence may be reduced. Accordingly, gaming system 300 may be enable the gaming machines 302, 304, 306 to share camera data and player presence information with each other. For example, the remote server or gaming machine 304 may indicate to gaming machines 302, 306 the presence of player 320 within field of vision 314 such that gaming machines 302, 306 may present an attract sequence. If the camera data is analyzed remotely, the remote server may instruct an individual gaming machine to perform an attract sequence based on camera data from adjacent machines in addition to or instead of camera data from the individual gaming machine's camera.

Still referring to FIG. 3, gaming system 300 may be able to determine the direction of travel 324 and/or the speed of travel of player 320 as player 320 moves along gaming machines 302, 304, 306. As discussed above, gaming machines 302, 304, 306 may share camera data and player presence information data with each other. Additionally or alternatively, the remote server may simultaneously analyze camera data from each of gaming machines 302, 304, 306. The camera data and player presence information may be analyzed to determine a direction of travel 324 and/or the speed of travel of the player 320. For example, if player 320 is initially detected within field of vision 318 and then later detected within field of vision 314, gaming system 300 may determine that player 320 is traveling in direction 324. System 300 may determine the speed that the player is traveling by tracking the time it takes for the player to move between fields of vision 318 and 314 or across a single field of vision. In some embodiments, image data captured from two (or more) cameras 308, 312, 316 may be combined to provide a stereoscopic view and hence depth perception. In further embodiments, each gaming machine may have at least two cameras such that image data captured from a single gaming machine may be combined to provide a stereoscopic view and hence depth perception. After determining the direction of travel 324 and/or speed of travel of player 320, gaming system 300 may predict the location of player 320. After predicting the location of player 320, gaming system 300 may initiate attract sequences on select gaming machines 302, 304, 306 currently be within field of vision 322 and gaming machines predicted to be within field of vision 322. In the example of FIG. 3, gaming system may determine that player 320 is walking in direction of travel 324 and initiate attract sequences on gaming machines 304 and 302.

In the above discussed arrangements, the attract sequences may be coordinated between the plurality of gaming machines 302, 304, 306. For example, if gaming system 300 determines that player is walking in direction of travel 324, a first portion of an attract sequence may be presented through gaming machine 304 and a second portion of the attract sequence may be presented through gaming machine 302. In the example, the first portion of the attract sequence occurs at a first time and the second portion of the attract sequence occurs at a second, later time such that the first and second portions of the attract sequence form the attract sequence. The attract sequence may be divided amongst any number of gaming machines within field of vision 322 and/or predicted to be within field of vision 322 in the future. The length of the portions of the attract sequence may depend on the speed of travel of player 320 along direction of travel 324. For example, if player 320 is moving at a first speed, the attract sequence may be displayed on each gaming machine for a first period of time. If player 320 is moving at a second speed, which is faster than the first speed, the attract sequence may be displayed on each gaming machine for a second period of time, which is shorter than the first period of time.

Figure 4:
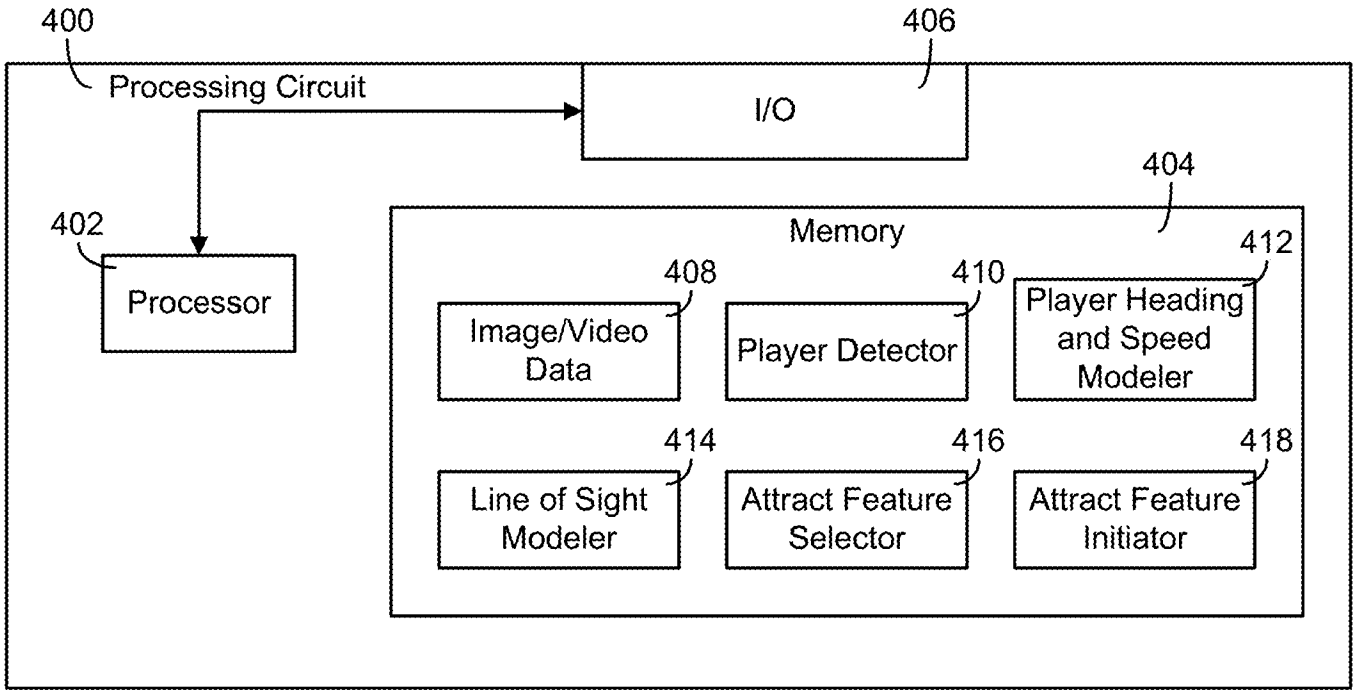
FIG. 4. is a block diagram of a processing circuit, according to an exemplary embodiment.

Referring now to FIG. 4, a block diagram of processing circuit 400 is shown according to an exemplary embodiment. Processing circuit 400 may be a processing component of any electronic device used as part of a gaming environment. For example, any of servers 208, 210, gaming machines 102, 204, mobile device 212, or desktop device 214 shown in FIG. 2 may include processing circuit 400. In another embodiment, processing circuit 400 may be part of a computing system that includes multiple devices. In such a case, processing circuit 400 may represent the collective components of the system (e.g., processors, memories, etc.). For example, server 208 in communication with gaming machine 102 may form a processing circuit configured to perform the operations described herein.

Processing circuit 400 may include a processor 402 and a memory 404. Memory 404 stores machine instructions that, when executed by processor 402, cause processor 402 to perform one or more operations described herein. The instructions may be programming modules. Processor 402 may include a microprocessor, FPGA, ASIC, any other form of processing electronics, or combinations thereof. Memory 404 may be any electronic storage medium such as, but not limited to, a floppy disk, a hard drive, a CD-ROM, a DVD-ROM, a magnetic disk, RAM, ROM, EEPROM, EPROM, flash memory, optical memory, or combinations thereof. Memory 404 may be a tangible storage medium that stores non-transitory machine instructions. Processing circuit 400 may include any number of processors and memories. In other words, processor 402 may represent the collective processing devices of processing circuit 400 and memory 404 may represent the collective storage devices of processing circuit 400. Processor 402 and memory 404 may be on the same printed circuit board or may be in communication with each other via a bus or other form of connection.

Input/output ("I/O") hardware 406 includes the interface hardware used by processing circuit 400 to receive data from other devices and/or to provide data to other devices. For example, a command may be sent from processing circuit 400 to a controlled device of gaming machine 102 via I/O hardware 406. I/O hardware 406 may include, but is not limited to, hardware to communicate on a local system bus and/or on a network. For example, I/O hardware 406 may include a port to transmit display data to an electronic display and another port to receive data from any of the devices connected to network 206 shown in FIG. 2.

Processing circuit 400 may store image/video data 408. In general, data 408 includes data obtained from gaming machine cameras (e.g., cameras 138, 308, 312, 316, etc.). Data 408 may also include data from other camera systems (e.g., security cameras). The data 408 may be received from the cameras at the processing circuit 400 through I/O hardware 406. Data 408 may be temporarily stored. For example, data 408 may function as a first-in first-out buffer. The first in first out buffer stores data 408 long enough for analysis on data 408 to be completed. Alternatively, data 408 may be permanently stored in memory 404. Data 408 may be received in real time or in approximately real time.

Memory 406 may include player detector module 410. Player detector module 410, when executed by processor 402, analyzes data 408 to determine the presence and location of a player within a field of view of a camera. Player detector module 410 may analyze camera data from individual cameras independently to determine the presence of players in front of individual gaming machines. The detected player's position is within the field of view of the camera of the gaming machine. Alternatively, player detector module 410 may analyze camera data from multiple cameras simultaneously to determine the presence of players throughout a gaming network. In such an arrangement, the player detector module 410 may function as a distributed multi-view camera player tracking system. The location of the player may be calculated based on triangulation of the player through multiple cameras. Triangulation of the player's location through multiple cameras may provide a more accurate location of the detected player. Player detection module 406 may also be able to distinguish multiple players. For example, player detection module 406 may receive camera data from a plurality of cameras. Multiple people may be in the fields of view of the cameras. Player detector module 406 can distinguish individuals and track the individuals as they move throughout the gaming floor. The distinction between individuals may be based on facial recognition, personal characteristics (e.g., height, weight, skin tone, hair color, etc.), and/or other characteristics (e.g., the presence of a hat, color of clothes, tattoos, etc.).

Memory 406 may include player heading and speed modeler module 412. As discussed above, the gaming system may have access to camera data from multiple gaming machines in the same general area. Accordingly, player heading and speed modeler module 412 analyzes data 408 to determine the direction of travel and speed of travel of detected players. The speed and direction of travel of detected players are determined by monitoring players as they move across a given field of view of a given camera and/or as the players move between fields of view of different cameras. Heading and speed modeler module 412 may be programmed with gaming machine position information to enable calculation of the detected player's speed and heading. The calculations may be made by analyzing positions of the player over periods of time. Heading and speed modeler module 412 may be executed by processor 402 simultaneously with player detector module 410. Alternatively, heading and speed modeler module 412 may be executed by processor 402 only after a player has been detected.

Memory 406 may include line of sight modeler module 414. Line of sight modeler module 414 may receive input from heading and speed modeler module 412. The input received from heading and speed modeler module 412 is used to estimate a line of sight of a detected player. As described above and below, the estimated line of sight may be used to later select and initiate attract features of gaming machines. Line of sight modeler module 414 may estimate the detected player's line of sight based on average lines of sight of people. Line of sight modeler module 414 may assume that the detected player's head is facing in the determined direction of travel. Alternatively, line of sight modeler module 414 may analyze image/video data 408 to determine the direction the detected person is looking through facial recognition software.

Memory 404 may include attract feature selector module 416. Attract feature selector module 416 selects particular attract features from a plurality of attract features. The attract features may be or may include an attract sequence. The selection may be made when a player is detected to be in the vicinity of a gaming machine or a plurality of gaming machines (e.g., a gaming machine bank). The gaming machine or plurality of gaming machines may or may not be occupied by another player. Attract feature selector module 416 may select a particular attract feature from a preprogrammed list of attract features. The selection may be based on the types of gaming machines in the vicinity of the detected player, the capabilities of the gaming machines in the vicinity of the detected the detected player (e.g., the types of outputs available for use in performing the attract feature or sequence, computing power, graphics capabilities, etc.), the direction of travel of the detected player, the speed of the detected player, the estimated line of sight of the detected player, or any combination thereof.

Memory 404 may also attract feature initiator module 418. Attract feature initiator module 418 sends the selected attract feature to the designated gaming machine or to a plurality of designated gaming machines. Attract feature initiator module 418 receives input from attract feature selector module 416. As discussed above, the attract feature may be performed by an individual electronic gaming machine or a plurality of electronic gaming machines. If the attract feature is performed by a plurality of electronic gaming machines, the attract feature may be coordinated amongst the plurality of electronic gaming machines.

Figure 5:
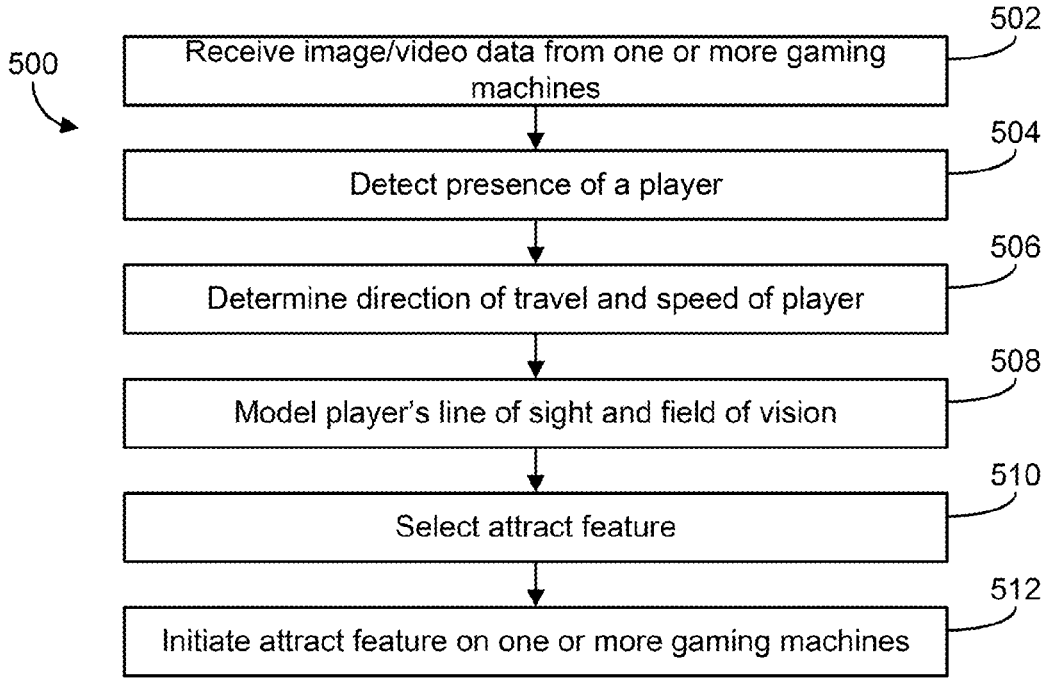
FIG. 5 is a flow diagram of a method of triggering an attract feature based on the detected presence of a patron, according to an exemplary embodiment.

Referring now to FIG. 5, a flow diagram of method 500 is shown. Method 500 is a process for initiating an attract feature on one or more gaming machines in a gaming system based on the detected presence of a player in the vicinity of the one or more gaming machines. Method 500 may be implemented by one or more processing circuits configured to execute stored machine instructions. For example, method 500 may be implemented by a processing circuit of a gaming machine or another device in communication with a gaming machine (e.g., processing circuit 400). In general, method 500 analyzes camera data from gaming machine cameras to determine when a player is near a gaming machine or a group of gaming machine. The camera data is analyzed to determine an appropriate attract feature to initiate on one or more gaming machines.

Method 500 includes receiving image/video data from at least one gaming machine of the gaming system (step 502). In some arrangements, image/video data may be received from sources other than gaming machines, such as security cameras. The at least one gaming machine includes a video camera (e.g., camera 138 of gaming machine 102). The gaming system may include a single gaming machine or a plurality of gaming machines (e.g., gaming system 300). The video camera may be configured to provide image data, video data, and/or audio data. The image/video data is sent to and received by the one or more processing circuits of the gaming system. The one or more processing circuits may be part of an Individual gaming machine or may be part of a remote server connected to at least one gaming machine. The image/video data may be stored in a memory of the processing circuit. The memory may be configured to store the image/video data in a first-in first-out buffer system.

Method 500 includes detecting the presence of a player near the at least one gaming machine (step 504). The gaming system determines the presence of a player near the at least one gaming machine by analyzing the image/video data. The data analysis may be performed by the one or more processing circuits. Image/video data from individual gaming machines may be independently analyzed to determine the presence of players in front of the individual gaming machines. Alternatively, image/video data from multiple cameras may be simultaneously analyzed to determine the presence of players throughout a gaming network. The gaming system may be configured to determine the specific location of the detected player (e.g., at an electronic gaming machine, within a field of view of a camera of an electronic gaming machine, etc.). The specific location may be determined through triangulation based on image/video data from multiple cameras.

In addition to determining the presence of a player near the at least one gaming machine, the system may be configured to determine a direction of travel of the player and a speed of the player (step 506). As discussed above, the gaming system may have access to camera data from multiple gaming machines in the same general area. Accordingly, the gaming system may be able to determine the direction of travel and speed of the player by analyzing the image/video data from the cameras. For example, the gaming system may time how long it takes for a player to pass through an entire field of vision of an individual camera or how long it takes for a player to move between fields of view of different cameras (e.g., fields of view of adjacent gaming machines).

Method 500 includes modeling the detected player's line of sight and field of vision (step 508). The gaming system estimates the line of sight of the detected player based on the determined direction of travel of the detected player and/or the speed of the detected player. Specifically, the gaming system may assume that the detected player is facing the direction of travel such that the line of sight is in the direction of travel. The system may calculate a field of view of the detected player based on the estimated line of sight. The field of view may be estimated based on an average field of view of an average person. Alternatively, the line of sight and field of view may be estimated through further analysis of the image/video data to determine which way the detected person's head is facing (e.g., through facial recognition software).

Method 500 includes selecting an attract feature (step 510). The gaming system may select a particular attract features or sequences from a plurality of attract features and sequences. The selection may be made when a player is detected to be in the vicinity of a gaming machine or a plurality of gaming machines (e.g., a gaming machine bank). Additionally, the gaming system selects one or more gaming machine to perform the selected attract feature. The gaming machine or plurality of gaming machines may or may not be occupied by another player. The selection may be based on the types of gaming machines in the vicinity of the detected player, the capabilities of the gaming machines in the vicinity of the detected the detected player (e.g., the types of outputs available for use in performing the attract feature or sequence), the direction of travel of the detected player, the speed of the detected player, the estimated line of sight of the detected player, or any combination thereof. After the attract feature is selected, the attract feature is initiated on the at least one gaming machine (step 512). The gaming system sends the attract feature or sequence to the designated gaming machine or to a plurality of designated gaming machines. As discussed above, the attract feature or sequence may be designed for a single gaming machine. A plurality of gaming machines may perform the same attract feature or sequence. Alternatively, a plurality of gaming machines can perform a coordinated attract feature or sequence in which different aspects of the attract feature or sequence may be performed by different gaming machines.

Figure 6:
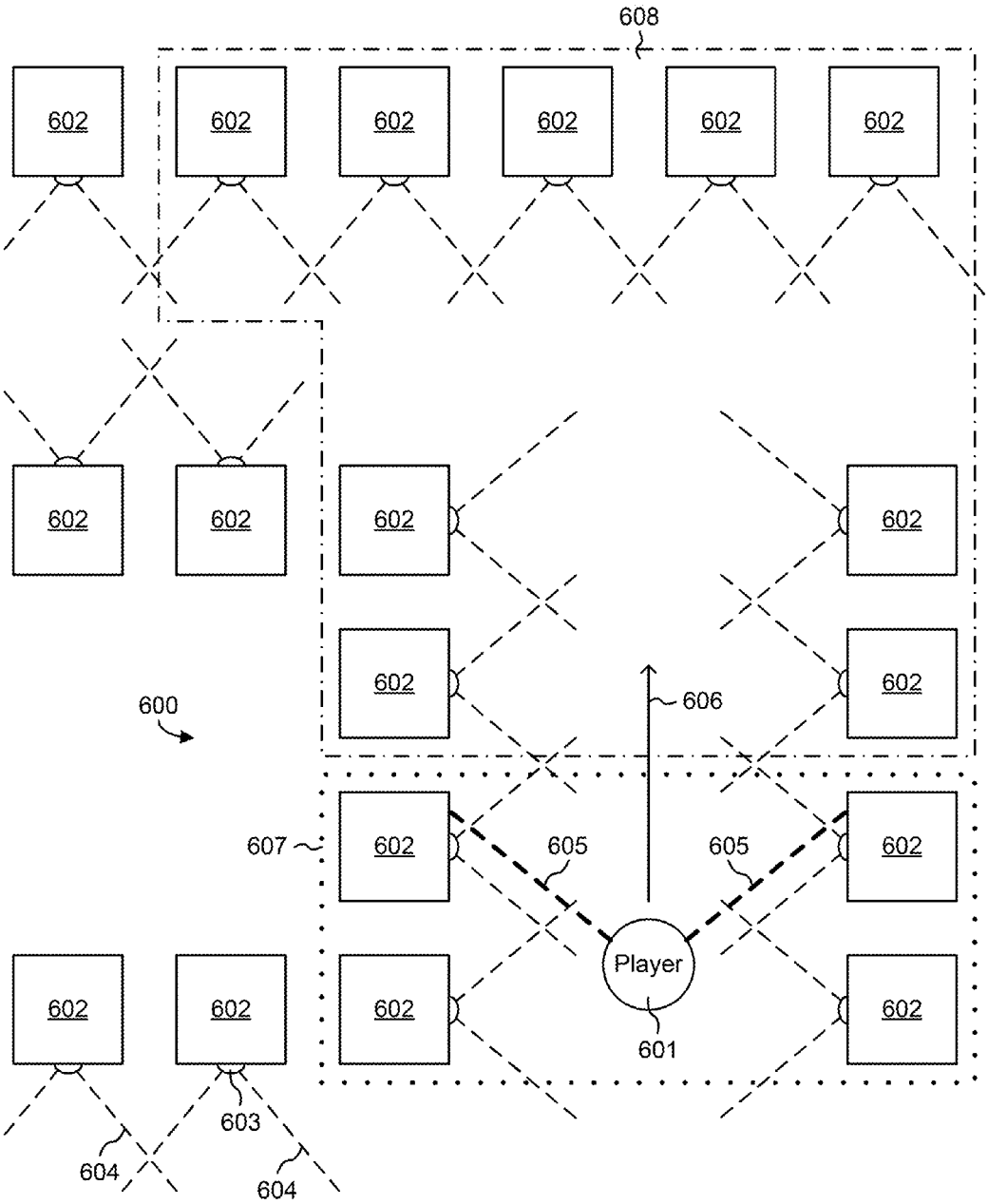
FIG. 6 is an illustration of a portion of a casino gaming floor, according to an exemplary embodiment.

Referring to FIG. 6, a floor plan of gaming system 600 is shown according to an exemplary embodiment. Player 601 is walking around the vicinity of various gaming machines 602 of gaming system 600. Gaming system 600 includes multiple banks of gaming machines 602. Each gaming machine 602 includes a camera 603 having a field of view 604. FIG. 6 is provided to exemplify the operation of a gaming system performing method 500 as described above. Accordingly, gaming system 600 may be configured to perform method 500 and initiate attract sequences based on the detected presence of player 601, the field of vision 605 of player 601, direction of movement 606 of player 601, and/or the detected speed of player 601.

The gaming system 600 may detect the presence and location of player 601 by monitoring fields of view 604 of cameras 603 of each gaming machine 602. As shown in FIG. 6, player is within the fields of view of approximately four different gaming machines, designated by box 607. Image/video data from the four gaming machines is analyzed by gaming system 600 to determine the location of player 601, the field of vision 605 of player 601, the direction of travel 606, and/or the speed of player 601. Based on these determination characteristics, gaming system 600 selects a plurality of gaming machines, marked by box 608, to perform an attract feature or sequence. The gaming machines within box 608 are within the field of vision 605 of player 601. Further, gaming system 600 predicts that player 601 will travel in the direction of the gaming machines within box 608 based on the known positions of the gaming machines and the direction of travel 606 of the player. The attract sequence may be designed for performance by a single gaming machine. In such an arrangement, each gaming machine 602 within box 608 performs the same attract sequence. Alternatively, the attract sequence may be a coordinated attract sequence in which each gaming machine 602 within box 608 performs an aspect of the coordinated attract sequence.

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on one or more computer storage medium for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, or other storage devices). Accordingly, the computer storage medium may be tangible and non-transitory.

The operations described in this specification can be implemented as operations performed by a data processing apparatus on data stored on one or more computer-readable storage devices or received from other sources.

The term "client or "server" include all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube), LCD (liquid crystal display), OLED (organic light emitting diode), TFT (thin-film transistor), plasma, other flexible configuration, or any other monitor for displaying information to the user and a keyboard, a pointing device, e.g., a mouse, trackball, etc., or a touch screen, touch pad, etc., by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending webpages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

The invention is claimed as follows:

1. An electronic gaming machine comprising:

at least one display device;

at least one video camera;

at least one processor; and at least one memory device which stores a plurality of instructions, which when executed by the at least one processor, cause the at least one processor to:

cause the at least one display device to display at least one first attract feature image associated with an electronic gaming machine attract mode, while displaying the at least one first attract feature image associated with the electronic gaming machine attract mode, capture, via the at least one video camera, video data of a designated area, automatically modify the electronic gaming machine attract mode based on the captured video data of the designated area, and cause the at least one display device to display at least one second, different attract feature image associated with the modified electronic gaming machine attract mode.

2. The electronic gaming machine of claim 1, wherein when executed by the at least one processor responsive to a determination occurring to exit the modified electronic gaming machine attract mode, the plurality of instructions cause the at least one processor to:

receive a wager for a play of a game, and for the wagered on play of the game:

determine a game outcome from a plurality of game outcomes, cause the at least one display device to display the determined game outcome, determine any award associated with the displayed game outcome, and cause the at least one display device to display any determined award associated with the displayed game outcome.

3. The electronic gaming machine of claim 1, wherein when executed by the at least one processor, the plurality of instructions cause the at least one processor to determine that no games are determined to be actively played and a patron is determined to be in the designated area prior to displaying the at least one first attract feature image associated with the electronic gaming machine attract mode.

4. The electronic gaming machine of claim 1, wherein the captured video data of the designated area includes a determined line of sight of at least one patron.

5. The electronic gaming machine of claim 1, wherein the capture video data of the designated area includes a determined direction of travel of at least one patron.

6. The electronic gaming machine of claim 5, wherein the determined direction of travel is in at least two dimensions.

7. A gaming system comprising:

at least one processor; and at least one memory device which stores a plurality of instructions, which when executed by the at least one processor, cause the at least one processor to:

communicate data which results in at least one display device displaying at least one first attract feature image associated with a gaming system attract mode, while the at least one display device is displaying the at least one first attract feature image associated with the gaming system attract mode, receive video data of a designated area captured by at least one video camera, automatically modify the gaming system attract mode based on the captured video data of the designated area, and communicate data which results in the at least one display device displaying at least one second, different attract feature image associated with the modified gaming system attract mode.

8. The gaming system of claim 7, wherein when executed by the at least one processor responsive to a determination occurring to exit the modified gaming system attract mode, the plurality of instructions cause the at least one processor to:

receive data associated with a wager for a play of a game, and for the wagered on play of the game:

determine a game outcome from a plurality of game outcomes, communicate data which results in the at least one display device displaying the determined game outcome, determine any award associated with the displayed game outcome, and communicate data which results in the at least one display device displaying any determined award associated with the displayed game outcome.

9. The gaming system of claim 7, wherein when executed by the at least one processor, the plurality of instructions cause the at least one processor to determine that no games are determined to be actively played and a patron is determined to be in the designated area prior to displaying the at least one first attract feature image associated with the gaming system attract mode.

10. The gaming system of claim 7, wherein the captured video data of the designated area includes a determined line of sight of at least one patron.

11. The gaming system of claim 7, wherein the capture video data of the designated area includes a determined direction of travel of at least one patron.

12. The gaming system of claim 11, wherein the determined direction of travel is in at least two dimensions.

13. A gaming system comprising:

at least one processor; and at least one memory device which stores a plurality of instructions, which when executed by the at least one processor, cause the at least one processor to:

cause at least a first one of a plurality of electronic gaming machines to display at least one first attract feature image associated with a gaming system attract mode, automatically modify the gaming system attract mode based on video data captured by at least one video camera, wherein the video data is captured by the at least one video camera while at least the first one of the plurality of electronic gaming machines is displaying the at least one first attract feature image associated with the gaming system attract mode, and cause at least a second, different one of the plurality of electronic gaming machines to display at least one second attract feature image associated with the modified gaming system attract mode.

14. The gaming system of claim 13, wherein responsive to a determination occurring to exit the modified gaming system attract mode, the plurality of instructions cause the at least one processor to:

receive data associated with a wager for a play of a game, and for the wagered on play of the game:

determine a game outcome from a plurality of game outcomes, communicate data which results in at least one display device of one of the electronic gaming machines displaying the determined game outcome, determine any award associated with the displayed game outcome, and communicate data which results in the at least one display device of one of the electronic gaming machines, displaying any determined award associated with the displayed game outcome.

15. The gaming system of claim 13, wherein the captured video data includes a determined line of sight of at least one patron.

16. The gaming system of claim 13, wherein the capture video data includes a determined direction of travel of at least one patron.

17. The gaming system of claim 16, wherein the determined direction of travel is in at least two dimensions.

* * * * *